US007918235B2

(12) United States Patent
Ohler

(10) Patent No.: US 7,918,235 B2
(45) Date of Patent: Apr. 5, 2011

(54) STEAM GENERATOR AUTO—BLOW DOWN AND SCALE REDUCTION SYSTEM

(76) Inventor: Jeffery Ohler, Clarksville, IN (US)

( * ) Notice: Subject to any disclaimer, the term of this patent is extended or adjusted under 35 U.S.C. 154(b) by 901 days.

(21) Appl. No.: 11/305,865

(22) Filed: Dec. 19, 2005

(65) Prior Publication Data

US 2007/0157949 A1 Jul. 12, 2007

(51) Int. Cl.
*B08B 9/08* (2006.01)

(52) U.S. Cl. ..... 134/94.1; 134/95.1; 134/104.1; 134/169 R

(58) Field of Classification Search ..... 134/166 R, 134/169 R

See application file for complete search history.

(56) References Cited

U.S. PATENT DOCUMENTS 4,763,678 A * 8/1988 Ott ..... 134/171
4,877,043 A * 10/1989 Carmichael et al. ..... 134/57 R
5,156,188 A * 10/1992 Wakita et al. ..... 137/625.3
5,279,676 A 1/1994 Oslin et al.
5,564,595 A 10/1996 Minissian
6,085,763 A * 7/2000 Esmaeili et al. ..... 134/113
6,833,032 B1 12/2004 Douglas et al.
2002/0185225 A1* 12/2002 Toshima et al. ..... 156/345.33

* cited by examiner

*Primary Examiner* — Michael Kornakov
*Assistant Examiner* — Ryan Coleman

(57) ABSTRACT

The invention is a dual functioning system for de-scaling or blowing down an electrically powered steam boiler. The steam boilers are generally used for sterilizing equipment and other items commonly used by health care professionals. The system includes a microprocessor controlled module, which is interfaced with the sterilizer controlled module, to measure the frequency and duration of the cleaning or blow down cycles. Typically, a cleaning cycle involves the use of an acid, such as phosphoric acid, to facilitate chemical removal of scale which is mineral deposits resulting from the use of hard water in the boiler. In the blow down cycle, the scale is removed by simple mechanical means without the use of a phosphoric acid cleaning solution. Various pumps and valves are utilized so that cleaning or blow down may be accomplished without having to disassemble or modify any input or drain lines.

11 Claims, 3 Drawing Sheets

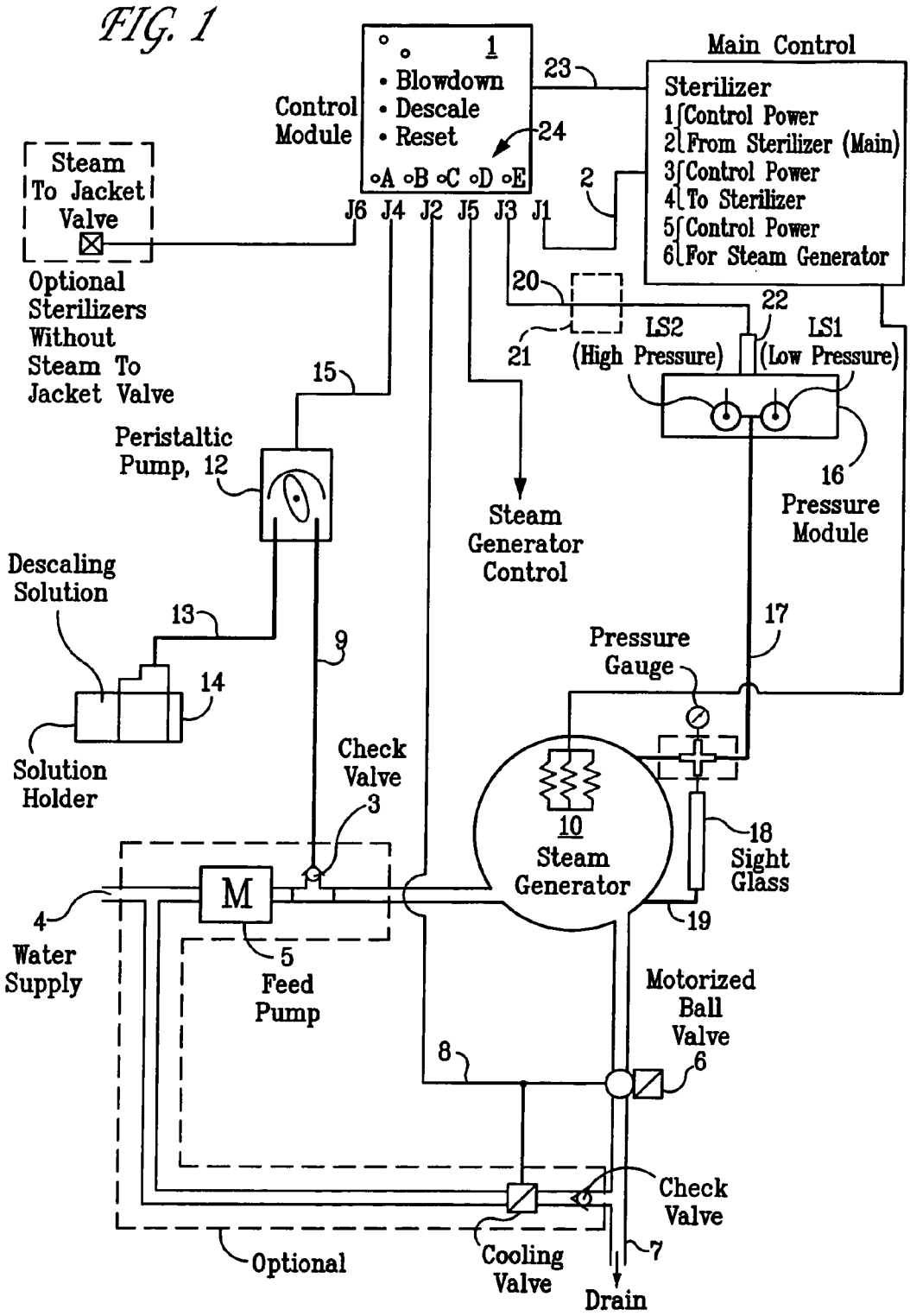
FIG. 1
Control Module
1
• Blowdown
• Descale
• Reset
24
A B C D E
J6 J4 J2 J5 J3 J1
23
Main Control
Sterilizer
1 Control Power
2 From Sterilizer (Main)
3 Control Power
4 To Sterilizer
5 Control Power
6 For Steam Generator
2
Steam To Jacket Valve
Optional Sterilizers Without Steam To Jacket Valve
20
21
22
LS2 (High Pressure)
LS1 (Low Pressure)
15
Peristaltic Pump, 12
Steam Generator Control
16 Pressure Module
Descaling Solution
13
9
14
Solution Holder
17
Pressure Gauge
Check Valve
3
10
Steam Generator
18 Sight Glass
19
M
4
Water Supply
5
Feed Pump
Motorized Ball Valve
6
8
Check Valve
Optional
Cooling Valve
7
Drain Blow-Down Cycle Chart De-Scale Cycle Chart

STEAM GENERATOR AUTO—BLOW DOWN AND SCALE REDUCTION SYSTEM

BACKGROUND OF THE INVENTION

Small steam generators have found application in many fields. These steam generators are usually electric powered and provide steam for cooking and sterilizing functions. Frequently the steam boilers are an integral part of such sterilizing or cooking ovens and may therefore be generally inaccessible once the cooking or sterilizing apparatus has been placed into service. These small steam generators suffer from the same problems that larger generators have, in that whenever water is heated or boiled, the natural consequence is the build-up of a residue. The residue derives from the fact that water contains many dissolved minerals which upon heating causes them to precipitate and bond to the inner boiler surfaces. This bonded material is commonly referred to in the industry as scale; consequently, descaling becomes a regular part of boiler maintenance. The scale itself, if not removed on a regular basis, can build up to the point where it can significantly reduce the boiler efficiency in addition to blocking drains and valves and even causing heater failure in electric powered steam boilers.

Steps can be taken to purify the water prior to its introduction into the steam generator but frequently these purification techniques prove to be troublesome, expensive and ineffective. An alternative is to descale the boiler at regular intervals during its operational cycles. Frequently, complete descaling of a boiler becomes time consuming, expensive and overly burdensome if done on a daily or even a weekly basis. In response, boiler operators have come to adopt an abbreviated type of descaling which is referred to as blowdown. This blowdown procedure simply involves switching the boiler off-line, filling the boiler and allowing it to pressurize and then opening an exit valve to allow the water and steam to quickly escape carrying with it entrained loosened particles of scale.

When the descaling procedure is put into practice the boiler is taken off line, filled with a cleaning solution, generally water and a strong acid, such as phosphoric acid, which cleaning solution is boiled in the boiler chamber itself. The tumbling boiling action of the strong acid solution chemically attacks and simultaneously dislodges and dissolves scale from the boiler interior. The solution is then driven from the boiler by steam pressure similar to the technique used in blowdown cleaning and the boiler is then flushed one or more times before being placed back on line.

The blowdown technique is not in and of itself effective over a long period of time. Consequently it follows that a boiler cleaner system capable of performing either a blowdown cycle or a descaling cycle would be ideal to meet the needs of the industry.

SUMMARY OF THE INVENTION

The present invention is a dual functioning automatic system for alternatively blowing down or descaling an electrically powered steam boiler. The steam boiler itself will have main controls and an inlet valve and an outlet valve, a boiling chamber and various other pressure and temperature monitoring devices as are common in such boilers. The invention consists of an auto-blowdown system designed to meet the daily maintenance requirements of small steam generators; but, it may have other applications as well. Generally it is well known that for proper maintenance and added life a steam generator should be subjected to a daily pressure blowdown and, depending upon the water quality, a monthly descaling. However, such maintenance requires qualified staff to monitor all aspects of the boiler operation and descaling. Properly trained operators are hard to find and may not always be available when boiler cleaning is required. The automatic blowdown and/or descaler of the present invention obviates the need for such trained artisans since once the cleaning begins the system is completely automated. The dual functioning system of the present invention is designed to provide a safe and effective method of maintaining large or small steam generators. It includes a microprocessor controlled unit that is interfaced with or connected independently of the sterilizer control module to monitor pressure and time to determine the frequency of required cleaning and blowdown cycles.

The usual method for descaling the interior of a steam boiler is to add a cleaning agent usually an acid such as phosphoric or hydrochloric or a combination of the two and allow the steam generator to fill with water and soak for a time. At the end of a predetermined time period the operator would then open a manual drain valve to empty the vessel. Frequently the operator would then rinse the steam generator but nevertheless leaving the possibility of acid residue in the boiler providing a hazard to instruments as well as contamination of the material being cleaned or steamed. If left unattended a boiler can become so overlaid with scale that it requires a trained technician to remove the heating element and physically chip or scrape the buildup from the chamber walls and heating element. The automated system of the present invention avoids such a necessity and results in the following advantages. (1) Safety of operation, (2) ease of operation, (3) lower maintenance cost, (4) longer steam generator life, (5) more efficient boiler operation, and (6) more efficient sterilizer operation.

A specific feature of the present invention is a control module mounted in an easily accessible position with respect to the steam boiler main controls with the control module being in electrical communication with the electronic circuitry to which the boiler is connected. The control module is further operatively connected to the inlet and outlet valves to enable opening and closing thereof. Another feature of the present invention is a pressure module in fluid communication with the pressure inside the boiler and in fluid communication with a transducer connected to the control module to enable the monitoring of the pressure inside the boiler and permit the activation of the descaling and blowdown steps through the control module.

In addition, the system includes a peristaltic pump connected to a fresh water supply and in fluid communication with the interior of the boiler, the boiling chamber, and contemporaneously connected to a reservoir of cleaning solution which is in fluid communication with the pump. Another feature of the present invention is the use of two transducers in electrical communication with the electronic circuitry such that the first transducer is connected to the control module and the second is in communication with the pressure module. The first and second transducers being operatively connected to enable functioning of the system.

Another feature is the use of phosphoric acid which is generally in the range of between about 15% and 45% by weight of cleaning solution with 30% being optimal. Frequently it is advantageous to include a chelating agent in the cleaning solution to promote and enhance the suspension of scale particles during the descaling cycle. Such chelating agents as EDTA (ethylene diaminate tracetic acid)-based chelating agents such as Versene 100E produced by The DOW Chemical Corporation have been found to be effective.

Also a surfactant can be used to reduce unwanted foaming of the cleaning solution. Such surfactants can be the industry standard surfactants NP5 and NP9. Another feature of the present invention is the selection of steam pressure during the blowdown and descaling cycles to be at a level below the operating pressure of the boiler and typically between 10 and 18 psi with 15 psi being most preferred.

The method of operation of the system is to activate the control module to open the boiler outlet valve while the boiler is under positive pressure below its normal operating pressure and then allow the contents of the boiler to discharge. Subsequently the outlet valve is closed and the peristaltic pump is activated to fill the boiler to its operating level and is either subsequently returned on line or if descaling is chosen, to refill the boiler with cleaning fluid and allow the boiler to come up to a pressure between 10 and 18 psi with 15 psi being most preferred remain in such condition for a period of time sufficient for the cleaning fluid to remove the scale from the interior of the boiler. Thereafter once again the boiler is drained under light pressure and is refilled with fresh water to its operating level with draining and refilling twice again so that the boiler has been flushed three times prior to its being placed on line.

DESCRIPTION OF THE DRAWINGS

FIG. 1 is a side elevational view of an electric steam boiler enabling the function of a combination steam sterilizer or steam cooking oven with certain internal components shown schematically in hidden lines.

DETAILED DESCRIPTION OF THE INVENTION

Figure 2:
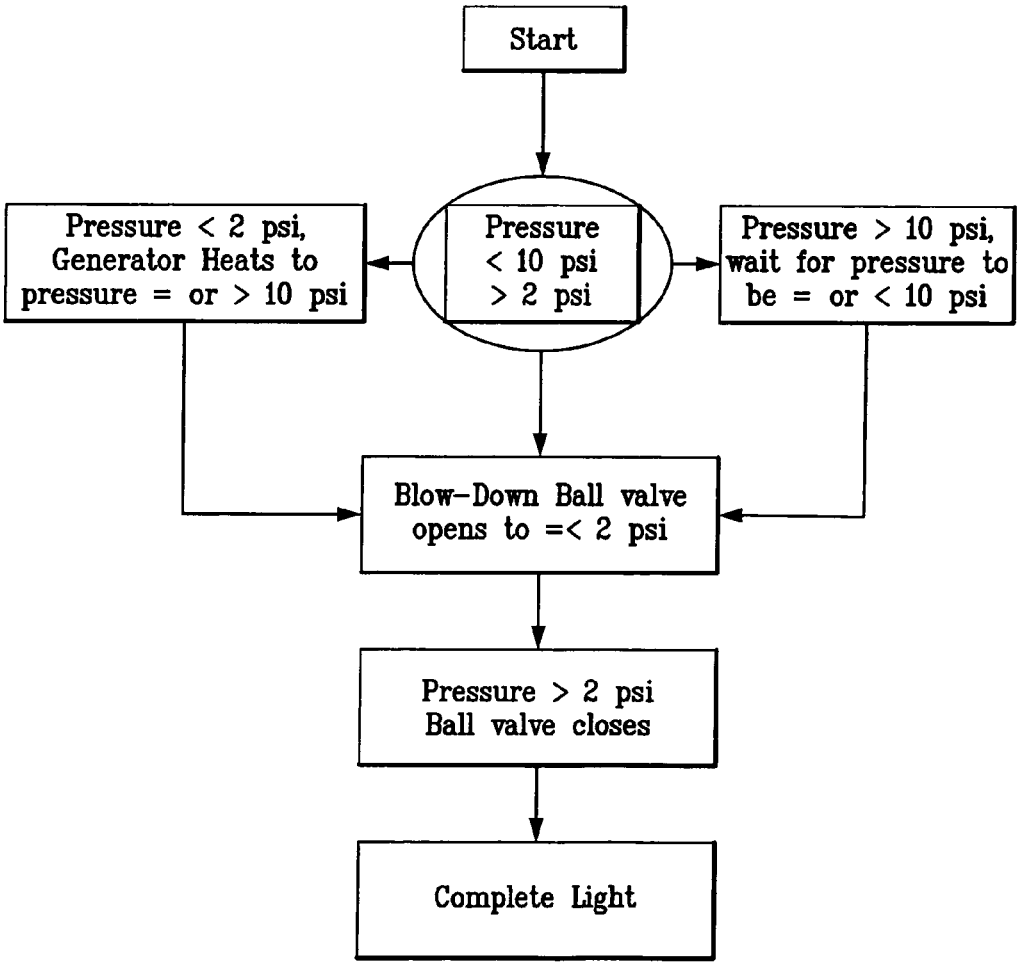
FIG. 2 is an operational chart showing the steps in the blowdown cycle.

FIG. 1 shows boiler 10 having a boiler control module 1 which is mounted in an easily accessible position with respect to the steam boiler main controls (not shown) and in electrical communication with the electronic main power circuitry 2 to which the boiler is connected. The boiler further includes an inlet valve 3, typically a check valve which can be opened to permit water to be introduced into the boiler through water line 4 which is in turn fed by water feed pump 5. In certain circumstances it may not be necessary to incorporate water feed pump 5 into the system but rather simply use the pressure of a municipal water line in line 4 controlled by inlet valve 3. Correspondingly outlet valve 6 which is preferably a motorized ball valve is used to release or drain water from the boiler through drain line 7. Typically the motorized valve is located exterior of the boiler itself and is actuated by electric current from control module 1 through electric line 8. Motorized ball valves such as outlet valve 6 and inlet valve 3 are standard in the industry and their selection would be readily apparent to those skilled in the art.

As an alternative to an electrically controlled valve for inlet valve 3 a more simple check valve could be used. The check valve would be in fluid communication with both water line 4 and cleaning solution line 9. Cleaning solution line 9 is fed from peristaltic pump 12 which in turn is connected to cleaning solution holder 14 by solution line 13. Peristaltic pump 12 can be any one of a number of peristaltic pumps that are known in the art. One such pump which has been found to be effective in the practice of the present invention is manufactured by MityFlex; Model 907 & 908 Series. Peristaltic pump 12 is controlled by control module 1 through peristaltic pump electric line 15.

A pressure module 16 is in communication with the interior of boiler 10 through module line 17 for monitoring the interior boiler pressure. In addition sight glass 18 can be used to visually observe the water level or cleaning solution level inside boiler 10. It may be that pressure module 16 is connected to one of two conduits 19 used to mount sight glass 18 to the boiler to avoid any undue multiplicity of orifices in boiler 10. Pressure module 16 is operatively connected to the control module through module line 20. Typically a transducer 22 is used to convert the pressure measured by pressure module 16 into an electric signal to be transmitted through module line 20 to control module 1. It may be that transducer 22 is an integral part of pressure module 16 or it may be an additional element.

The signal from transducer 22 is important in the overall operation of the dual functioning system of the present invention since the steps of both the blowdown and descaling operations are keyed to both time and boiler pressure. Control module 1 is also importantly connected to the main control of the sterilizer/boiler through main control connector line 23. Control module 1 further includes various function indicator lights 24 A through E with A being the on/off light, B being the fault light, C being the complete light, D being the operate light and E being the mode light indicating either the blowdown mode or the descaling mode.

In an alternative embodiment there may be two transducers in module line 20. The first transducer 21 is connected to control module 1 and then to second transducer 22 heretofore described, with the second transducer operatively connected to pressure module 16.

FIG. 2 is a blowdown cycle chart and explains the operation of the blowdown cycle. When the selector switch is set to the auto blowdown system as indicated by light 24E, the main controls are switched from control of the boiler/sterilizer/oven to processing control module 1. The boiler operation is dedicated to the blowdown cycle and is off line with respect to its typical function. With the blowdown mode selected, all processes are automatic. As indicated in FIG. 2, once the blowdown mode is initiated the blowdown cycle will open outlet valve 6. The pressure module 16 measures the internal boiler pressure. Upon initiating the blowdown cycle the control module checks the boiler status determining whether it is on or off. If the boiler is off the control turns on the boiler and allows the boiler to fill and pressurize to 10 psig. If the boiler is on the control checks the pressure. If the pressure is greater than 10 psig the control module pauses letting the pressure drop to the required 10 psig. If the pressure module 16 detects that the pressure in the boiler is less than 2 psig, the boiler is energized and the water heated until the pressure becomes equal to 10 psig. When the pressure 10 psig is reached the motorized ball valve 6 opens to empty boiler 10. This opening of motorized ball valve 6 allows the steam and water in the boiler to quickly exit expelling entrained particles of scale. When the boiler reaches a pressure of 2 psig or less the motorized ball valve 6 closes and the complete light 24C illuminates indicating that the blowdown cycle has been completed and at this point the operator returns the selector switch to sterilizer control. The control module no longer has control of the boiler and the main controls take over.

Figure 3:
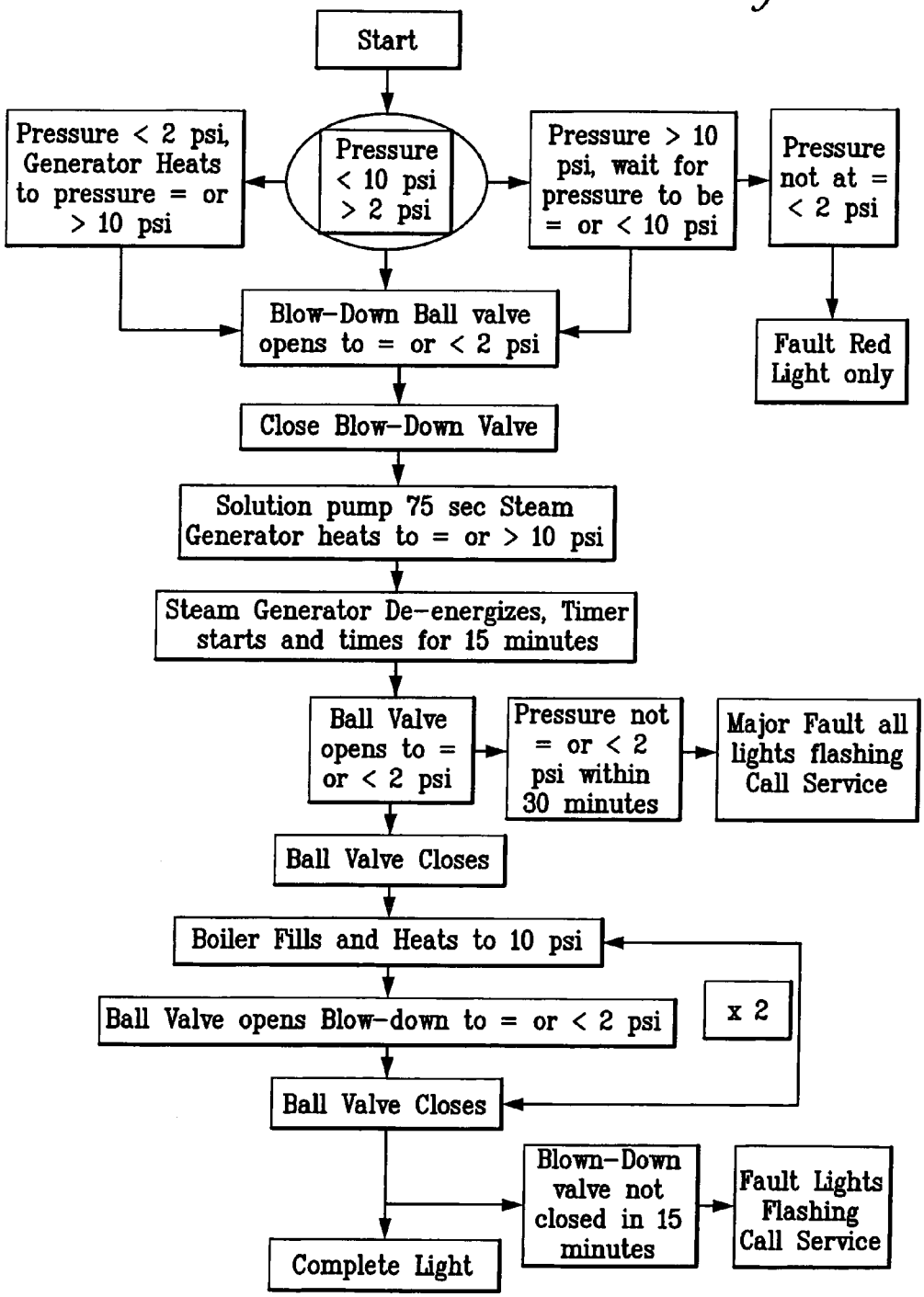
FIG. 3 is an operational chart showing the steps in a descaling cycle.

FIG. 3 shows the descale cycle chart and describes the descaling cycle in detail. The steps for the blowdown cycle are identical to the steps for the descale cycle except in the descale cycle the operation continues after the ball valve or blowdown valve 6 closes. In this case the function indicator light 24E indicates the descale mode, except now once the blowdown valve is closed the peristaltic pump 12 is automatically turned on and cleaning solution from cleaning solution reservoir 14 is simultaneously pumped and blended with water from water line 4 to fill the boiler to operating level. The cleaning solution is preferably 30% phosphoric acid but may contain various chelating agents and surfactants as previously discussed.

The peristaltic pump may be controlled by a timer or by a level detector being in operable association with sight glass 18. The boiler is then powered and heating of the water and cleaning solution begins with subsequent boiling in a tumultuous fashion to loosen and dissolve scale from the interior of the boiler. This operation continues until the boiler pressure reaches 10 psig then the steam generator de-energizes and a timer starts and initiates an approximate 15 minute soaking or dissolution period. At the end of the soaking cycle outlet valve 6 is opened and the boiler pressure is allowed to drop to less than 2 psi. If the pressure does not drop to 2 psi or less within 30 minutes the fault light 24B illuminates indicating service is required. Most commonly the problem is found to be blockage in outlet valve 6 or drain line 7 caused by scale and debris.

Once 2 psi boiler pressure is reached the ball valve 6 is automatically closed and the boiler filled and heated until the pressure reaches 10 psi. The ball valve is then opened and a blowdown cycle begins to flush the boiler with the pressure dropping to less than 2 psi. The ball valve is then automatically closed, the boiler filled and again heated until the pressure reaches 10 psi. This flushing process is repeated for a total of three times whereupon the ball valve closes for a final time. If the ball valve 6 does not close in 15 minutes the fault light 24B illuminates indicating service is required. Again the most common problem is a blockage of the valve. Once the ball valve 6 is closed a final time the complete light 24C illuminates, the operate light 24D darkens as does the mode light 24E. The operator then returns the selector switch on the auto blowdown control to sterilizer and the main controls once again take over.

As can be seen from the above description, the invention allows for either automatic blowdown or descaling of a boiler with minimal operator involvement. The dual functioning system of this invention enables automatic and simplified safe descaling or blowing down of a boiler using the same equipment which, once installed, can be repeatedly used for both descaling and blowdown maintenance operations.

Because of the dual function of the system it is also possible to begin a descaling operation and by moving selector switch 11 from blowdown to descaling, continue the blowdown cycle and expand it into a descaling cycle. No other system has this economic, easy to use dual functioning feature.

Having thus described the invention what is claimed is:

1. A dual functioning automatic system for de-scaling and blowing down an electrically powered steam boiler, which includes main controls, an inlet valve, and an outlet valve, comprising:

a processing control module for controlling the blowing down and de-scaling of the boiler wherein control of the boiler is switched from the main controls to the processing control module when the user selects to have blow down cleaning performed on the boiler, wherein the processing control module is mounted in an easily accessible position with respect to the steam boiler main controls and in electrical communication with the electronic circuitry to which the boiler is connected and further operatively connected to the inlet and outlet valves to enable opening and closing thereof, the inlet valve being a check valve which is in a cleaning solution line that is in fluid communication with a water supply line, a pressure module in fluid communication with the pressure inside the boiler and in electrical communication with a transducer arrangement connected to the processing control module to enable the monitoring of the pressure inside the boiler, wherein the pressure module is associated with a timer measuring elapsed time and the combination of the pressure module and timer is configured to enable the processing control module to determine the need for and frequency of de-scaling and blow down steps, a peristaltic pump controlled by a timer or level detector and in fluid communication with a reservoir of cleaning solution, which is in fluid communication with the check valve thereby permitting introduction of cleaning solution into the water supply line which feeds into the interior of the boiler, wherein the transducer arrangement is comprised of two transducers operatively connected in tandem to each other and wherein the processing control module is configured to perform a blow down of the boiler by pressurizing the boiler to a desired pressure with water and opening the boiler outlet valve such that the contents of the boiler are discharged, and wherein the processing control module is configured to perform de-scaling of the boiler by pressurizing the boiler to a desired pressure with cleaning solution, soaking the boiler in the cleaning solution while the boiler is de-energized, opening the boiler outlet valve to discharge the boiler's contents, and refilling the boiler with fresh water.

2. The system of claim 1 wherein the cleaning solution comprises water and phosphoric acid.

3. The system of claim 2 wherein the phosphoric acid is present in an amount between about 15 and 45 percent by weight of cleaning solution.

4. The system of claim 3 wherein the phosphoric acid comprises about 30 percent by weight of cleaning solution.

5. The system of claim 4 wherein the cleaning solution includes a chelating agent.

6. The system of claim 1 wherein the desired pressure during the de-scaling of the boiler is in the range of between 10 and 18 PSI.

7. The system of claim 6 wherein the desired pressure during the de-scaling of the boiler is 15 PSI.

8. The system of claim 5 wherein the chelating agent is an ethylene diaminate tracetic acid based chelating agent.

9. The system of claim 2 wherein the cleaning solution includes a surfactant.

10. The dual functioning system of claim 1 wherein the processing control module comprises circuitry to start a blow down of the boiler, enable the continuation of the blow down, permit the operation of a reset switch, permit the opening of a valve connected thereto in fluid communication with boiler, permit the operation of additional motorized ball valves in fluid communication with the boiler system, enable the operation of the peristaltic pump, enable the operation of a complete light, a fault light, and an operate light and also enable the interruption of normal steam generator operation to permit either de-scaling or blow down.

11. The system of claim 1 wherein the processing control module enables draining and refilling of the boiler with fresh water at the end of a de-scaling operation.

* * * * *